US010712052B2

(12) United States Patent
Najafifard

(10) Patent No.: US 10,712,052 B2
(45) Date of Patent: Jul. 14, 2020

(54) COOLING SYSTEM WITH IMPROVED COMPRESSOR STABILITY

(71) Applicant: Heatcraft Refrigeration Products LLC, Stone Mountain, GA (US)

(72) Inventor: Fardis Najafifard, Decatur, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 142 days.

(21) Appl. No.: 15/678,448

(22) Filed: Aug. 16, 2017

(65) Prior Publication Data

US 2019/0056151 A1 Feb. 21, 2019

(51) Int. Cl.
*F25B 40/00* (2006.01)
*F25B 7/00* (2006.01)
(Continued)

(52) U.S. Cl.
CPC ..... *F25B 7/00* (2013.01); *F25B 1/10* (2013.01); *F25B 5/02* (2013.01); *F25B 6/02* (2013.01); *F25B 40/00* (2013.01); *F25B 2400/0417* (2013.01); *F25B 2400/05* (2013.01); *F25B 2400/051* (2013.01); *F25B 2400/054* (2013.01);
(Continued)

(58) Field of Classification Search
CPC .. F25B 6/04; F25B 40/02; F25B 40/06; F25B 43/006; F25B 2400/0417; F25B 2400/0419; F25B 2400/05; F25B 2400/051; F25B 2400/054
See application file for complete search history.

(56) References Cited

U.S. PATENT DOCUMENTS 8,191,377 B2 * 6/2012 Aiyama ..... F25B 41/062 62/210
2013/0213066 A1 * 8/2013 Litch ..... F25B 40/02 62/117
2015/0151610 A1 6/2015 Kraiss et al.

FOREIGN PATENT DOCUMENTS

DE 102013113229 A1 6/2015
JP H10047794 2/1998
(Continued)

OTHER PUBLICATIONS

Xing, Meibo et al., "Thermodynamic analysis on a two-stage transcritical CO2 heat pump cycle with double ejectors," Energy Conversion and Management, vol. 88, Dec. 1, 2014, pp. 677-683.
(Continued)

*Primary Examiner* — Edward F Landrum
*Assistant Examiner* — Daniel C Comings
(74) *Attorney, Agent, or Firm* — Baker Botts L.L.P.

(57) ABSTRACT

A system includes a high side heat exchanger, a flash tank, a first load, a second load, a first compressor, and a heat exchanger. The flash tank is configured to store the refrigerant from the high side heat exchanger. The first load is configured to use the refrigerant from the flash tank to remove heat from a first space proximate to the first load. The second load is configured to use the refrigerant from the flash tank to remove heat from a second space proximate to the second load. The first compressor is configured to compress the refrigerant from the first load. The heat exchanger is configured to transfer heat from the refrigerant from the first compressor and the second load to the refrigerant from the high side heat exchanger, and direct the refrigerant from the first compressor and the second load to a second compressor.

18 Claims, 3 Drawing Sheets

(51) Int. Cl.

| | |
|---|---|
| ***F25B 5/02*** | (2006.01) |
| ***F25B 1/10*** | (2006.01) |
| ***F25B 6/02*** | (2006.01) |

(52) U.S. Cl.
CPC ..... *F25B 2400/22* (2013.01); *F25B 2500/08* (2013.01)

(56) References Cited

FOREIGN PATENT DOCUMENTS

| | | | |
|---|---|---|---|
| WO | 2006024182 | A2 | 3/2006 |
| WO | 2008019689 | A2 | 2/2008 |

OTHER PUBLICATIONS

European Patent Office, Extended European Search Report, Application No. 18187387.8, dated Dec. 14, 2018, 10 pages.
Gullo, P. et al., "Energy and environmental performance assessment of R744 booster supermarket refrigeration systems operating in warm climates," International Journal of Refrigeration 64, Apr. 1, 2016, pp. 61-79.
European Patent Office, Communication pursuant to Article 94(3) EPC, Application No. 18187387.8, dated Sep. 13, 2019, 6 pages.

* cited by examiner

100

COOLING SYSTEM WITH IMPROVED COMPRESSOR STABILITY

TECHNICAL FIELD

This disclosure relates generally to a cooling system.

BACKGROUND

Cooling systems cycle a refrigerant to cool various spaces. For example, a refrigeration system may cycle refrigerant to cool spaces near or around a refrigeration unit.

SUMMARY OF THE DISCLOSURE

According to one embodiment, a system includes a high side heat exchanger, a flash tank, a first load, a second load, a first compressor, and a heat exchanger. The high side heat exchanger is configured to remove heat from a refrigerant. The flash tank is configured to store the refrigerant from the high side heat exchanger. The first load is configured to use the refrigerant from the flash tank to remove heat from a first space proximate to the first load. The second load is configured to use the refrigerant from the flash tank to remove heat from a second space proximate to the second load. The first compressor is configured to compress the refrigerant from the first load. The heat exchanger is configured to transfer heat from the refrigerant from the first compressor and the second load to the refrigerant from the high side heat exchanger, and direct the refrigerant from the first compressor and the second load to a second compressor.

According to another embodiment, a method includes removing heat from a refrigerant using a high side heat exchanger. The method also includes storing the refrigerant from the high side heat exchanger in a flash tank. The method further includes removing heat from a first space using a first load including the refrigerant from the flash tank. The method also includes removing heat from a second space using a second load including refrigerant from the flash tank. The method further includes compressing the refrigerant from the first load using a first compressor. The method also includes transferring heat from the refrigerant from the first compressor and the second load to the refrigerant from the high side heat exchanger using a heat exchanger. The method further includes directing the refrigerant from the first compressor and the second load to the second compressor using the heat exchanger.

According to yet another embodiment, a system includes a first load, a second load, a first compressor, and a heat exchanger. The first load is configured to use a refrigerant from a flash tank to remove heat from a first space proximate to the first load. The second load is configured to use the refrigerant from the flash tank to remove heat from a second space proximate to the second load. The first compressor is configured to compress the refrigerant from the first load. The heat exchanger is configured to transfer heat from the refrigerant from the first compressor and the second load to the refrigerant from a high side heat exchanger. The heat exchanger is also configured to direct the refrigerant from the first compressor and the second load to a second compressor.

Certain embodiments may provide one or more technical advantages. For example, an embodiment maintains a stable temperature and pressure of refrigerant entering compressors of the cooling system. As a result, risk of damage to the compressors due to exposure to refrigerant that is too hot or too cold is minimized. As another example, an embodiment maintains a stable temperature of refrigerant entering compressors of the cooling system without the need for specialized hardware in the flash tank or injecting additional refrigerant into the system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
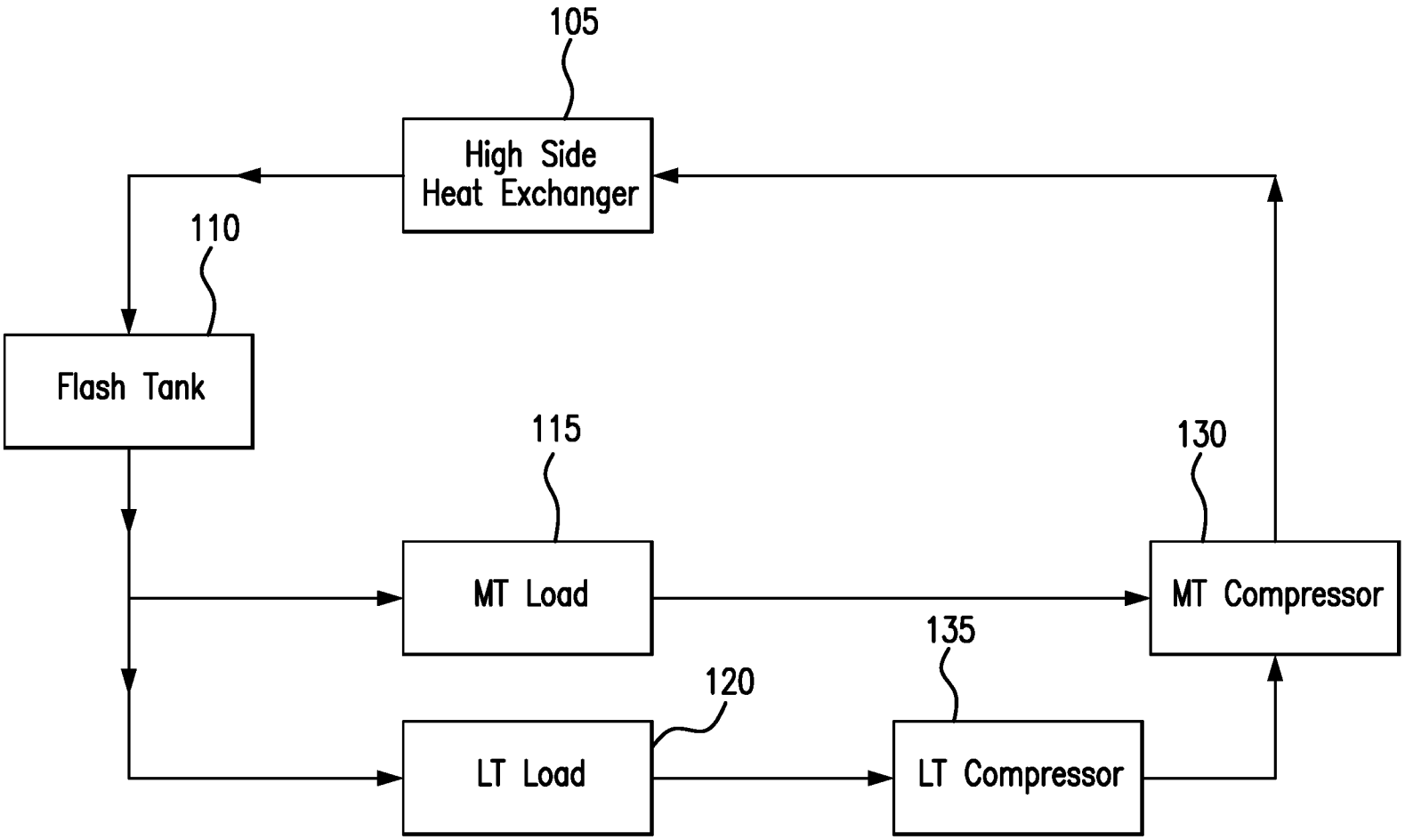
FIG. 1 illustrates an example cooling system.
Figure 2:
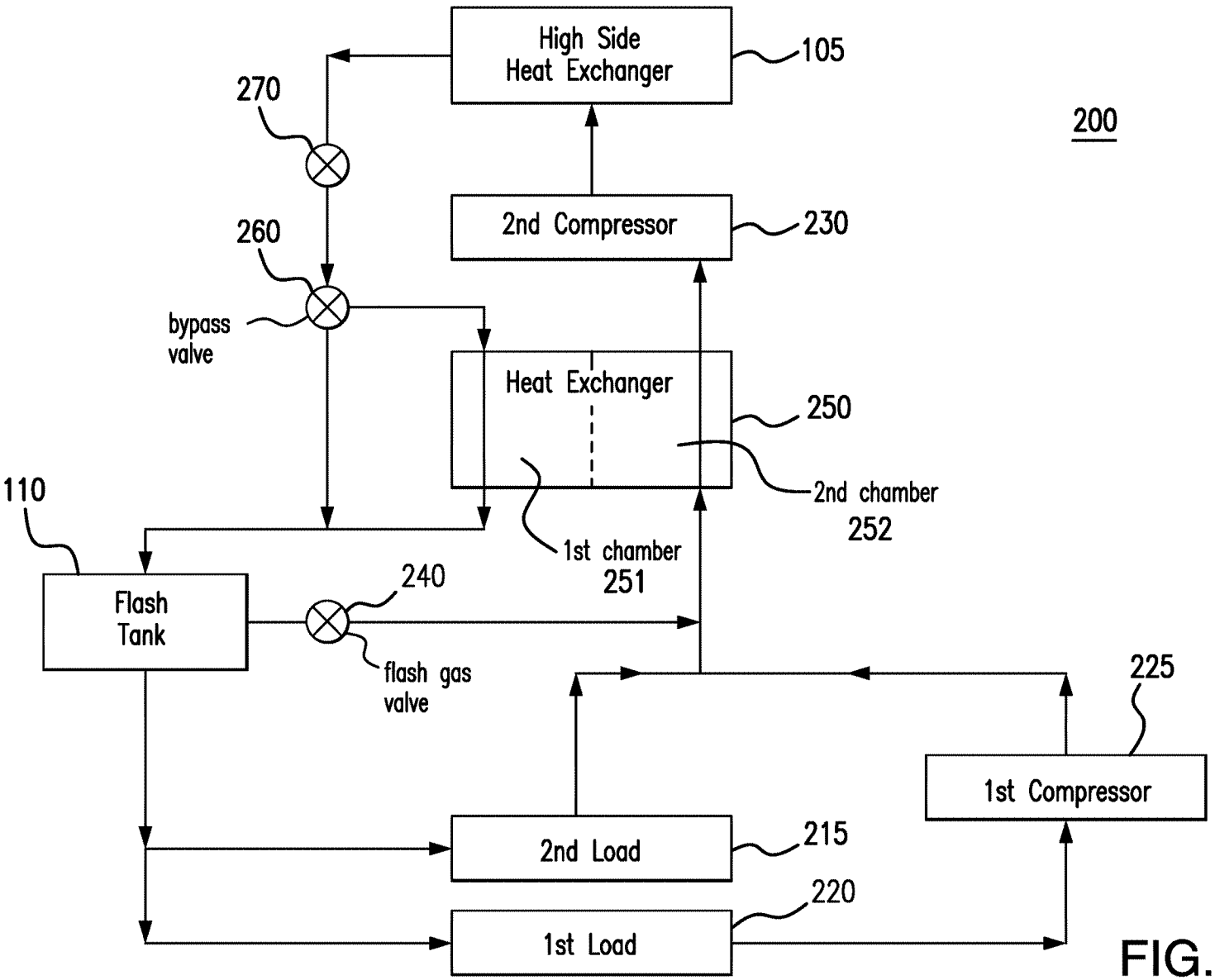
FIG. 2 illustrates an example cooling system including a heat exchanger, according to certain embodiments.
Figure 3:
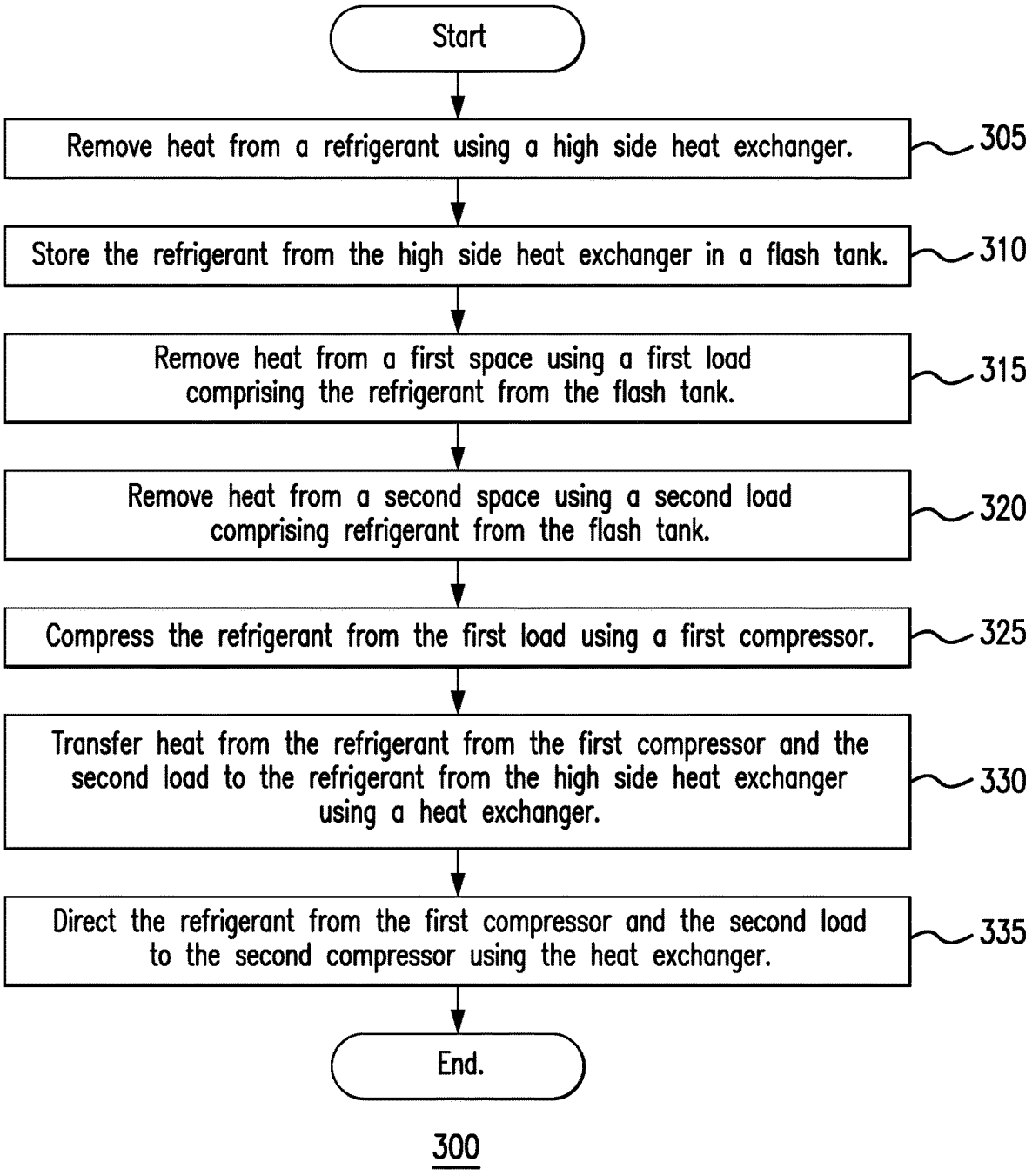
FIG. 3 is a flowchart illustrating a method of operating the example cooling system of FIG. 2.

Embodiments of the present disclosure and its advantages are best understood by referring to FIGS. 1 through 3 of the drawings, like numerals being used for like and corresponding parts of the various drawings.

Cooling systems may cycle a refrigerant to cool various spaces. For example, a refrigeration system may cycle refrigerant to cool spaces near or around refrigeration loads. In certain installations, such as at a grocery store for example, a refrigeration system may include different types of loads. For example, a grocery store may use medium temperature loads and low temperature loads. The medium temperature loads may be used for produce and the low temperature loads may be used for frozen foods. The compressors for these loads may be chained together. For example, the discharge of the low temperature compressor for the low temperature load may be fed into the medium temperature compressor that also compresses the refrigerant from the medium temperature loads. The discharge of the medium temperature compressor is then fed to a high side heat exchanger that removes heat from the compressed refrigerant.

In cooling systems, it is important that refrigerant entering the compressors maintains a temperature within a certain range. If the refrigerant in the compressors is too warm or too cold, it risks damaging the compressors. As a result, there is a need for refrigerant entering compressors to maintain a stable temperature and pressure. As an example, conventional cooling systems may inject liquid refrigerant into the suction line to mix with the refrigerant traveling to the compressor to maintain a stable temperature and pressure of the refrigerant traveling to the compressor. As another example, conventional cooling systems may use hardware such as a suction accumulator inside of a flash tank through which refrigerant traveling to compressors may travel to stabilize its temperature and pressure.

This disclosure contemplates using a heat exchanger to maintain a stable temperature and pressure of refrigerant fed into compressors of cooling systems. The heat exchanger may use the stable conditions of the refrigerant traveling to the flash tank as a passive control on the refrigerant traveling to the compressor. In certain embodiments, when refrigerant is traveling from a high pressure expansion valve to the flash tank, it has a relatively stable temperature and pressure. By passing that relatively stable refrigerant through the heat exchanger at the same time that refrigerant traveling to the compressor passes through the heat exchanger, the temperature and pressure of the refrigerant traveling to the compressor may be stabilized. Stabilization of the temperature and pressure of refrigerant traveling to the compressor may be achieved without the need to install or maintain specialized hardware such as an accumulator, or expend energy and resources to implement other potential controls.

The system will be described in more detail using FIGS. 1 through 3. FIG. 1 will describe an existing refrigeration system. FIGS. 2 and 3 will describe the refrigeration system with a heat exchanger.

FIG. 1 illustrates an example cooling system 100. As shown in FIG. 1, system 100 includes a high side heat exchanger 105, a flash tank 110, a medium temperature load 115, a low temperature load 120, a medium temperature compressor 130, and a low temperature compressor 135.

High side heat exchanger 105 may remove heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 may store refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant is released from flash tank 110. By releasing flash gas, the pressure within flash tank 110 may be reduced.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant may flow from flash tank 110 to both the low temperature and medium temperature portions of the refrigeration system. For example, the refrigerant may flow to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115, the refrigerant may change from a liquid state to a gaseous state as it absorbs heat.

Refrigerant may flow from low temperature load 120 and medium temperature load 115 to compressors 130 and 135. This disclosure contemplates system 100 including any number of low temperature compressors 135 and medium temperature compressors 130. The low temperature compressor 135 and medium temperature compressor 130 may increase the pressure of the refrigerant. As a result, the heat in the refrigerant may become concentrated and the refrigerant may become a high pressure gas. Low temperature compressor 135 may compress refrigerant from low temperature load 120 and send the compressed refrigerant to medium temperature compressor 130. Medium temperature compressor 130 may compress refrigerant from low temperature compressor 135 and medium temperature load 115. Medium temperature compressor 130 may then send the compressed refrigerant to high side heat exchanger 105.

As shown in FIG. 1, the discharge of low temperature compressor 135 is fed to medium temperature compressor 130. Medium temperature compressor 130 then compresses the refrigerant from medium temperature load 115 and low temperature compressor 135. As additional low temperature loads and/or low temperature compressors are added to system 100, the strain on medium temperature compressor 130 increases. As medium temperature compressor 130 does more work, the overall efficiency of system 100 falls. As a result of reduced efficiency, the temperature and pressure of refrigerant traveling, for example, from first compressor 224 to second compressor 230 may become less stable. Less stable refrigerant traveling to second compressor 230 risks damaging second compressor 230.

FIG. 2 illustrates an example of cooling system 200. As illustrated in FIG. 2, system 200 includes high side heat exchanger 105, flash tank 110, a first load 215, a second load 220, a first compressor 225, a second compressor 230, flash gas valve 240, heat exchanger 250, bypass valve 260, and high pressure expansion valve 270. The components of system 200 may be similar to the components of system 100. However, the components of system 200 may be configured differently than the components of system 100 to integrate the heat exchanger 250. In particular embodiments, system 200 protects first compressor 225 and/or second compressor 230 from damage by maintaining the temperature and pressure of the refrigerant entering those compressors within a certain range through use of heat exchanger 250.

In system 200, flash tank 110 may receive the refrigerant from heat exchanger 250. In some embodiments, flash tank 110 may receive the refrigerant from a second chamber 252 of heat exchanger 250. Flash thank 110 may then direct the refrigerant to first load 220 and second load 215. Refrigerant from first load 220 may flow to first compressor 225. First compressor 225 may direct the refrigerant to heat exchanger 250. Refrigerant from second load 215 may flow to heat exchanger 250. Second compressor 230 may receive the refrigerant from heat exchanger 250 and direct the refrigerant to high side heat exchanger 105. High side heat exchanger 105 may direct the refrigerant to heat exchanger 250. In some embodiments, high side heat exchanger 105 may direct the refrigerant to a first chamber 251 of heat exchanger 250.

As illustrated in FIG. 1, flash tank 110 may store refrigerant received from high side heat exchanger 105. This disclosure contemplates flash tank 110 storing refrigerant in any such state such as, for example, a liquid state and/or a gaseous state. In system 200, refrigerant leaving flash tank 110 is fed to first load 220 and second load 215. In some embodiments, a flash gas and/or a gaseous refrigerant is released from flash tank 110. By releasing flash gas, the pressure within flash tank 110 may be reduced. In some embodiments of system 200, flash tank 110 releases a flash gas to flash gas valve 240. Flash gas valve 240 may direct the flash gas from flash tank 110 to heat exchanger 250. In certain embodiments, flash gas valve 240 receives flash gas from flash tank 110 and directs it to second chamber 252 of heat exchanger 250.

Refrigerant may flow from first load 220 and second load 215 to compressors of system 200. This disclosure contemplates system 200 including any number of compressors. In some embodiments, refrigerant from first load 220 flows to first compressor 225. In other embodiments, refrigerant from heat exchanger 250 flows to second compressor 230. First compressor 225 and second compressor 230 may increase the pressure of the refrigerant. First compressor 225 may compress refrigerant from first load 220. As a result, the heat in the refrigerant may become concentrated and the refrigerant may become a high pressure gas. First compressor 225 may then send the compressed refrigerant to heat exchanger 250. In some embodiments, first compressor 225 sends the compressed refrigerant to second chamber 252 of heat exchanger 250. Second compressor 230 may compress refrigerant from heat exchanger 250. Second compressor 250 may then send the compressed refrigerant to high side heat exchanger 105.

Heat exchanger 250 may transfer heat from the refrigerant from first compressor 225 and second load 215 to the refrigerant from high side heat exchanger 105. Heat exchanger 250 may further direct the refrigerant from first compressor 225 and second load 215 to second compressor 230. Heat exchanger 250 may transfer heat through any means, for example, it may transfer heat passively through proximity of the refrigerant. Heat exchanger 250 may also increase pressure of the refrigerant to facilitate heat transfer. Heat exchanger 250 may apply, any pressure suitable to facilitating heat transfer between refrigerant, for example, heat exchanger 250 may apply a pressure rating of 650 psi.

In some embodiments, heat exchanger includes first chamber 251 and second chamber 252. First chamber 251 may direct the refrigerant from high side heat exchanger 105 to flash tank 110. Second chamber 252 may direct the refrigerant from first compressor 225 and second load 215 to second compressor 230. In such embodiments, heat exchanger 250 transfers heat from second chamber 252 to first chamber 251. Flash tank 110 receives the refrigerant from first chamber 251 of heat exchanger 250. First compressor 225 directs the refrigerant to second chamber 252 of heat exchanger 250. Second compressor 230 receives the refrigerant from second chamber 252 of heat exchanger 250 and directs it to high side heat exchanger 105. High side heat exchanger 105 directs the refrigerant to first chamber 251 of heat exchanger 250.

Refrigerant from first compressor 225 and second load 215 may have a range of temperatures, for example the mixture of refrigerant from first compressor 225 and second load 215 may have a temperature of approximately 50 to 70° F. In some embodiments, refrigerant from first compressor 225 and second load 215 may mix with flash gas from flash tank 110 before entering heat exchanger 250 as a mixture. Flash gas from flash tank 110 may have a range of temperatures, for example, flash gas from flash tank 110 may have a temperature of 20° F. Refrigerant from high side heat exchanger 105 may have a lower, more stable temperature, for example, refrigerant from high side heat exchanger may have a temperature of approximately 33° F. By passing refrigerant from first compressor 225 and second load 215 through heat exchanger 250, heat exchanger 250 may transfer heat from refrigerant from first compressor 225 and second load 215 to refrigerant from high side heat exchanger 105.

As a result, certain embodiments of system 200 maintain the temperature and pressure of refrigerant traveling to the compressors within a certain range. For example, it may be desirable to maintain a temperature of approximately 20 to 50° F. for the refrigerant entering second compressor 230. Refrigerant entering second compressor 230 at approximately 20 to 50° F. may prevent liquid refrigerant droplets from entering second compressor 230 and causing damage. Refrigerant entering compressor 230 at temperatures above 50° F. may risk damaging the compressor. By transferring heat from refrigerant from first compressor 225 and second load 215 to refrigerant from high side heat exchanger 105, heat exchanger 250 may stabilize the temperature and pressure of refrigerant entering second compressor 230. Thus, damage to the compressors from exposure to refrigerant that is too hot or too cold is minimized. In certain embodiments, such results are achieved without the need for installing and maintaining additional, specialized hardware in the flash tank, or consuming additional refrigerant and energy injecting additional liquid refrigerant to mix with the refrigerant traveling to the compressors of the cooling system.

System 200 may include high pressure expansion valve 270. High pressure expansion valve 270 may receive refrigerant from high side heat exchanger 105 and direct the refrigerant from high side heat exchanger 105 to heat exchanger 250. In some embodiments, high pressure expansion valve 270 may direct the refrigerant to bypass valve 260. High pressure expansion valve 270 may separate refrigerant into high pressure refrigerant and low pressure refrigerant.

System 200 may include bypass valve 260. Bypass valve 260 may receive refrigerant from high side heat exchanger 105 and direct the refrigerant from high side heat exchanger 105 to heat exchanger 250 and/or flash tank 110. In some embodiments, bypass valve 260 receives the refrigerant from high side heat exchanger 105 and directs the refrigerant to first chamber 251 of heat exchanger 250 and/or flash tank 110. In some embodiments, bypass valve 260 receives the refrigerant from high pressure expansion valve 270. Bypass valve 260 may prevent the flow of the refrigerant from high side heat exchanger 105 to heat exchanger 250, and alternatively direct the refrigerant to flash tank 110.

System 200 may include flash gas valve 240. Flash gas valve 240 may receive flash gas from flash tank 110 and direct the flash gas to heat exchanger 250. In certain embodiments, flash gas valve 240 may receive flash gas from flash tank 110 and direct the flash gas to second chamber 252 of heat exchanger 250.

In some embodiments of system 200, the ratio of a temperature of the refrigerant from second load 215 and a temperature of the refrigerant from first compressor 225 is less than one. In yet other embodiments, a ratio of a temperature from the refrigerant from second load 215 and a temperature of the refrigerant from first compressor 225 is greater than thirty percent. The ratio of the temperature of the refrigerant from second load 215 and the temperature of the refrigerant from first compressor 225 may be less than one, and/or greater than 30%, may stabilize the temperature and pressure of refrigerant entering the compressors using heat exchanger 250. Thus, system 200 may stabilize the temperature and pressure of refrigerant entering compressors 225 and/or 230 when a mixture of refrigerants has various temperatures when mixed.

This disclosure contemplates system 200 including any number of components. For example, system 200 may include any number of loads 215 and/or 220. As another example, system 200 may include any number of compressors 225 and/or 230. As a further example, system 200 may include any number of heat exchangers 250, and heat exchanger 250 may include any number of chambers. As yet another example, system 200 may include any number of high side heat exchangers 105 and flash tanks 115. This disclosure also contemplates cooling system 200 using any appropriate refrigerant. For example, cooling system 200 may use a carbon dioxide refrigerant.

FIG. 3 is a flowchart illustrating a method 300 of operating the example cooling system 200 of FIG. 2. Various components of system 200 perform the steps of method 300. In certain embodiments, performing method 300 may improve the stability of the refrigerant entering compressors of cooling system 200.

High side heat exchanger may begin by removing heat from a refrigerant in step 305. In step 310, flash tank 110 may store the refrigerant from high side heat exchanger 105. In step 315, first load 220 may remove heat from a first space proximate to the first load 220. Then in step 320, second load 215 may remove heat from a second space proximate to a second load 215. In step 325, first compressor 225 may compress the refrigerant from first load 220. In step 330, heat exchanger 250 may transfer heat from the refrigerant from first compressor 225 and second load 215 to the refrigerant from the high side heat exchanger 105. In step 335, heat exchanger 250 may direct the refrigerant from first compressor 225 and second load 215 to second compressor 230.

Modifications, additions, or omissions may be made to method 300 depicted in FIG. 3. Method 300 may include more, fewer, or other steps. For example, steps may be performed in parallel or in any suitable order. While discussed as various components of cooling system 200 performing the steps, any suitable component or combination of components of system 200 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a high side heat exchanger configured to remove heat from a refrigerant;

a flash tank configured to store the refrigerant from the high side heat exchanger;

a first load configured to use the refrigerant from the flash tank to remove heat from a first space proximate to the first load;

a second load configured to use the refrigerant from the flash tank to remove heat from a second space proximate to the second load;

a first compressor configured to compress the refrigerant from the first load; and a heat exchanger configured to:

transfer heat from the refrigerant from the first compressor and the second load to the refrigerant from the high side heat exchanger; and direct the refrigerant from the first compressor and the second load to a second compressor;

maintain each of a first temperature and first pressure of the refrigerant entering the second compressor within a corresponding predefined range;

wherein, in order to maintain each of the first temperature and first pressure within the corresponding predefined range, a ratio of a second temperature in degrees Fahrenheit of the refrigerant output from the second load and a third temperature in degrees Fahrenheit of the refrigerant output from the first compressor is greater than thirty percent.

2. The system of claim 1, further comprising a bypass valve configured to:

prevent the flow of the refrigerant from the high side heat exchanger to the heat exchanger; and direct the refrigerant from the high side heat exchanger to the flash tank.

3. The system of claim 1, further comprising a flash gas valve configured to direct a flash gas from the flash tank to the heat exchanger, wherein the flash tank is further configured to discharge the flash gas.

4. The system of claim 1, wherein the heat exchanger comprises:

a first chamber configured to direct the refrigerant from the high side heat exchanger to the flash tank; and a second chamber configured to direct the refrigerant from the first compressor and the second load to the second compressor.

5. The system of claim 1, wherein the first space is at a lower temperature than the second space.

6. The system of claim 1, wherein the ratio of the second temperature in degrees Fahrenheit of the refrigerant output from the second load and the third temperature in degrees Fahrenheit of the refrigerant output from the first compressor is less than one.

7. A method comprising:

removing heat from a refrigerant using a high side heat exchanger;

storing the refrigerant from the high side heat exchanger in a flash tank;

removing heat from a first space using a first load comprising the refrigerant from the flash tank;

removing heat from a second space using a second load comprising refrigerant from the flash tank;

compressing the refrigerant from the first load using a first compressor;

transferring heat from the refrigerant from the first compressor and the second load to the refrigerant from the high side heat exchanger using a heat exchanger; and directing the refrigerant from the first compressor and the second load to the second compressor using the heat exchanger;

maintaining each of a first temperature and first pressure of the refrigerant entering the second compressor within a corresponding predefined range;

wherein, in order to maintain each of the first temperature and first pressure within the corresponding predefined range, a ratio of a second temperature in degrees Fahrenheit of the refrigerant output from the second load and a third temperature in degrees Fahrenheit of the refrigerant output from the first compressor is greater than thirty percent.

8. The method of claim 7, further comprising:

preventing the flow of the refrigerant from the high side heat exchanger to the heat exchanger using a bypass valve;

directing the refrigerant from the high side heat exchanger to the flash tank using the bypass valve.

9. The method of claim 7, further comprising:

discharging a flash gas from the flash tank;

directing the flash gas from the flash tank to the heat exchanger using a flash gas valve.

10. The method of claim 7, further comprising:

directing the refrigerant from the high side heat exchanger to the flash tank using a first chamber of the heat exchanger;

directing the refrigerant from the first compressor and the second load to the second compressor using a second chamber of the heat exchanger.

11. The method of claim 7, wherein the first space is at a lower temperature than the second space.

12. The method of claim 7, wherein the ratio of the second temperature in degrees Fahrenheit of the refrigerant output from the second load and the third temperature in degrees Fahrenheit of the refrigerant output from the first compressor is less than one.

13. A system comprising:

a first load configured to use a refrigerant from a flash tank to remove heat from a first space proximate to the first load;

a second load configured to use the refrigerant from the flash tank to remove heat from a second space proximate to the second load;

a first compressor configured to compress the refrigerant from the first load; and a heat exchanger configured to:

transfer heat from the refrigerant from the first compressor and the second load to the refrigerant from a high side heat exchanger; and direct the refrigerant from the first compressor and the second load to a second compressor;

maintain each of a first temperature and first pressure of the refrigerant entering the second compressor within a corresponding predefined range;

wherein, in order to maintain each of the first temperature and first pressure within the corresponding predefined range, a ratio of a second temperature in degrees Fahrenheit of the refrigerant output from the second load and a third temperature in degrees Fahrenheit of the refrigerant output from the first compressor is greater than thirty percent.

14. The system of claim 13, further comprising a bypass valve configured to:

prevent the flow of the refrigerant from the high side heat exchanger to the heat exchanger; and direct the refrigerant from the high side heat exchanger to the flash tank.

15. The system of claim 13, further comprising a flash gas valve configured to direct a flash gas from the flash tank to the heat exchanger;

wherein, the flash tank is further configured to discharge the flash gas.

16. The system of claim 13, wherein the heat exchanger comprises:

a first chamber configured to direct the refrigerant from the high side heat exchanger to the flash tank; and a second chamber configured to direct the refrigerant from the first compressor and the second load to the second compressor.

17. The system of claim 13, wherein the first space is at a lower temperature than the second space.

18. The system of claim 13, wherein the ratio of the second temperature in degrees Fahrenheit of the refrigerant output from the second load and the third temperature in degrees Fahrenheit of the refrigerant output from the first compressor is less than one.

* * * * *